US006857152B1

(12) United States Patent
Chow

(10) Patent No.: US 6,857,152 B1
(45) Date of Patent: Feb. 22, 2005

(54) WATER BED STRUCTURE

(76) Inventor: Andy S. Chow, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/890,166

(22) Filed: Jul. 14, 2004

(51) Int. Cl.[7] ..... A47C 27/10
(52) U.S. Cl. ..... 5/681; 5/685; 5/678; 5/917
(58) Field of Search ..... 5/681, 665, 678, 5/680, 682, 683, 685, 687, 917, 920

(56) References Cited

U.S. PATENT DOCUMENTS 3,766,579 A * 10/1973 Shields ..... 5/681
3,778,852 A * 12/1973 Penn et al. ..... 5/422
3,787,907 A * 1/1974 Pennington et al. ..... 5/687
3,802,004 A * 4/1974 Whitney ..... 5/687
3,842,455 A * 10/1974 Whitney ..... 5/687
3,918,110 A * 11/1975 Cantillo et al. ..... 5/687
3,925,835 A * 12/1975 Pennington et al. ..... 5/687
4,006,501 A * 2/1977 Phillips ..... 5/687
4,012,269 A * 3/1977 Tabata et al. ..... 156/251
4,038,712 A * 8/1977 Miller ..... 5/687
4,055,867 A * 11/1977 Phillips ..... 5/687
4,078,960 A * 3/1978 Phillips ..... 156/227
4,079,473 A * 3/1978 Phillips ..... 5/687
4,100,635 A * 7/1978 Mitchell et al. ..... 5/681
4,101,995 A * 7/1978 Phillips ..... 5/687
4,150,447 A * 4/1979 Miller ..... 5/687
4,181,990 A * 1/1980 Santo ..... 5/687
4,193,151 A * 3/1980 Calleance ..... 5/681
4,245,364 A * 1/1981 Calleance ..... 5/680
4,334,331 A * 6/1982 Santo ..... 5/680
4,491,993 A * 1/1985 Santo ..... 5/678
4,501,036 A * 2/1985 Santo ..... 5/687
4,513,463 A * 4/1985 Santo ..... 5/681
4,517,693 A * 5/1985 Viesturs ..... 5/681
4,534,078 A * 8/1985 Viesturs et al. ..... 5/681
4,637,082 A * 1/1987 Moore et al. ..... 5/681
4,638,518 A * 1/1987 Barbulla ..... 5/687
4,651,368 A * 3/1987 Santo ..... 5/681
4,663,790 A * 5/1987 Santo ..... 5/681
4,700,419 A * 10/1987 Santo ..... 5/681
4,739,530 A * 4/1988 Santo ..... 5/681
RE32,665 E * 5/1988 Santo ..... 5/680
4,941,223 A * 7/1990 Santo ..... 5/681
5,535,463 A * 7/1996 Chiu ..... 5/681
5,669,091 A * 9/1997 Chung ..... 5/687
5,727,269 A * 3/1998 Chung ..... 5/680
5,794,287 A * 8/1998 Chung ..... 5/687
5,845,353 A * 12/1998 Chow ..... 5/685
5,901,392 A * 5/1999 Hsieh ..... 5/681
6,035,470 A * 3/2000 Chow ..... 5/687
6,343,393 B1 * 2/2002 Chow ..... 5/681

* cited by examiner

*Primary Examiner*—Robert G. Santos

(57) ABSTRACT

A water bed structure includes water containing bodies, a concave bed body, air protection borders and a bed housing, wherein the water containing bodies are installed in accommodating chambers formed by the concave bed body and the air protection borders, and are placed into the bed housing. The concave bed body has each of four sides thereof provided with at least two openings for installing four unfilled air protection borders through the openings. The four air protection borders are provided with air inlet plugs that are located at the openings at the four sides of the four air protection borders. The assembled air protection borders and the concave bed of the water containing beds are placed into an inverted U-shape bed housing in an upward direction, such that the openings of the concave bed body and the air inlet plugs of the air protection borders are concealed.

4 Claims, 5 Drawing Sheets

WATER BED STRUCTURE

BACKGROUND OF THE INVENTION (a) Field of the Invention

The invention relates to a water bed structure, and more particularly, to a water bed structure, which is capable of lowering costs of replacement materials when replaceable materials thereof are worn, beatifying appearance of the overall water bed structure, completely eliminating a drawback of water leakage, and lengthening lifespan as well as easily controlling elasticity for softness and hardness, thereby optimizing practicability thereof.

(b) Description of the Prior Art

Referring to FIG. 1 showing an elevational schematic view of a prior double-bed, the prior water bed structure comprises left and right water-containing bodies 1 and bed housing 2. Each of the water containing bodies 1 has an outer layer 11; a water inlet plug 12 at an appropriate position of each outer layer 11; a plurality of equidistant and parallel transverse pull strip spacers 13 that are loop-like and hollow structures; and a water opening 14 disposed at an appropriate position of each transverse pull strip spacer 13 and for allowing injected water to flow through. In addition, upper and lower edges of the transverse pull strip spacers 13 are molded with inner walls of the outer layers 11 of the water containing bodies 1 using heat. The bed housing 2 has an upper surface thereof provided with a plurality of disassembling openings 21 for installing or taking out the aforesaid unfilled water containing bodies 1 by folding and compressing the water containing bodies 1. Moreover, the water inlet plugs 12 are exactly located at openings 21 to facilitate injecting water into the water containing bodies 1. Around the bed housing 2 are air protection borders 3 in form of a continuous frame body. The air protection borders 3 have an air inlet plug 31 for injecting air, a central air spacer 33 disposed longitudinally to have an overall structure formed as a shape of two adjacent rectangles. That is, the air protection borders 3 are constructed with two accommodating chambers 32 for accommodating the two aforesaid water containing bodies 1 therein.

According to the aforesaid structure, the prior water bed has advantages of being less prone to wavering, having satisfactory stability, being capable of adjusting hardness and softness as desired as well as eliminating water leakage. However, the prior water bed yet has the following drawbacks:

1. According to the prior water bed structure, the bed housing and the air protection borders are a formed integral. Supposed wear of either the bed housing or the air protection borders occur after long-term use, it is obliged to replace both the bed housing and the air protection borders as they are an integral structure. Thus, material costs are increased to lower practicability of the water bed.
2. When the water bed structure is in assembly, the openings of the bed housing and the air inlet plugs of the air protection borders are exposed, such that esthetical values of an overall appearance of the water bed are reduced.
3. After a certain period of usage of the prior water bed structure, the air protection borders are likely to dilate to further shorten usage lifespan of the water bed.
4. The prior water bed structure lacks additional sanitary mattresses, thereby again lowering effects and economical values of the water bed.

Therefore, in view of the aforesaid drawbacks of the prior invention, it is essential to provide a novel and more practical water bed structure, which overcomes the aforesaid drawbacks and can be more extensively applied to conform to industrial requirements.

SUMMARY OF THE INVENTION

The primary object of the invention is to provide a water bed structure having a concave bed body, air protection borders and a bed housing as separate parts thereof. When wear occurs after long-term usage, any of the aforesaid three parts can be individually replaced instead having to replace an integral structure made of the three aforesaid parts, thereby reducing material costs for elevating practicability of the water bed.

The secondary object of the invention is to provide a water bed structure having a bed housing in an inverted U-shape design. Using the inverted U-shape design, openings of the concave bed body and air inlet plugs of the air protection borders are concealed to beautify an overall appearance of the water bed, preventing the air protection borders from dilating, and lengthening usage lifespan of the water bed as well as completely eliminating a drawback of water leakage.

The other object of the invention is to provide a water bed structure having adhesive tapes or zippers at a periphery of the concave body or the bed housing thereof. Using the adhesive tapes or zippers, various sanitary and health mattresses can be additionally installed to optimize effects and economical values of the water bed.

To accomplish the aforesaid objects, a water bed structure according to the invention comprises water containing bodies, a concave bed body, air protection borders and a bed housing. The concave bed body has each of four sides thereof provided with at least two openings for installing four unfilled air protection borders through the openings. At appropriate positions, the four air protection borders are also provided with air inlet plugs that are exactly located at the openings at the four sides of the four air protection borders. The four air protection border form a large accommodating space when assembled. The accommodating space has a middle part thereof disposed with a longitudinal central air bag or a long sponge, such that two water containing body accommodating chambers are formed. Within each of two outer layers is a plurality of parallel transverse pull strip spacers that are loop-like and hollow structures. At appropriate positions, two ends of the longitudinal central air bag or the long sponge are provided with adhesive tapes attached to head and foot ends of the accommodating chambers. The bed housing is devised in an inverted U-shape. The assembled air protection borders and the concave bed of the water containing beds are placed into the bed housing in an upward direction, such that the openings of the concave bed body and the air inlet plugs of the air protection borders are concealed, thereby beautifying an overall appearance of the water bed, preventing the air protection borders from dilating, and lengthening usage lifespan of the water bed as well as completely eliminating a drawback of water leakage.

DETAILED DESCRIPTION OF THE PREFERRED EMBODIMENTS

To better understand effects, structures and characteristics of the invention, detailed descriptions of preferred embodiments shall be given with the accompanying drawings below.

Figure 1:
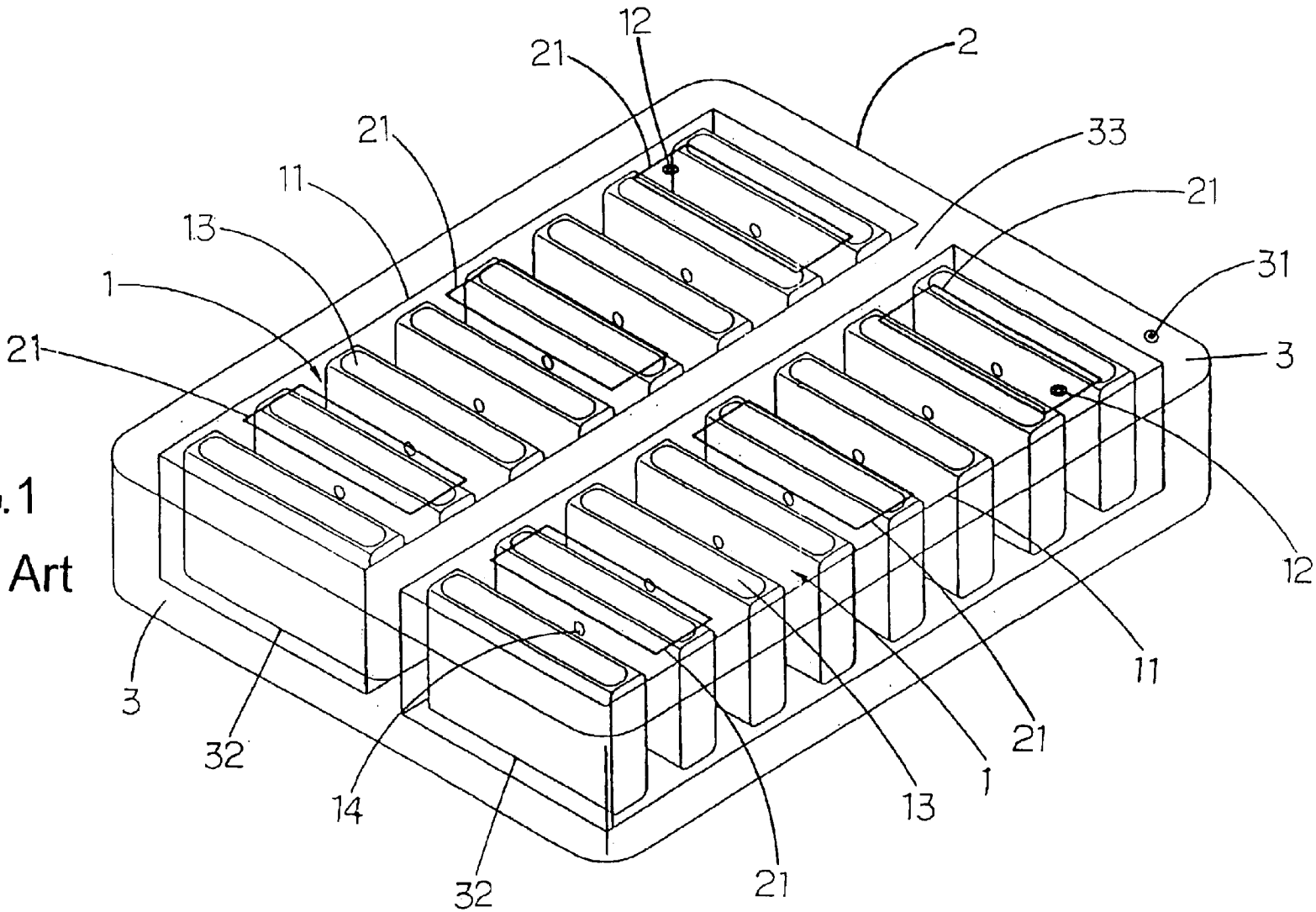
FIG.1 Prior Art
FIG. 1 shows an elevational schematic view of a prior double-bed.
Figure 2:
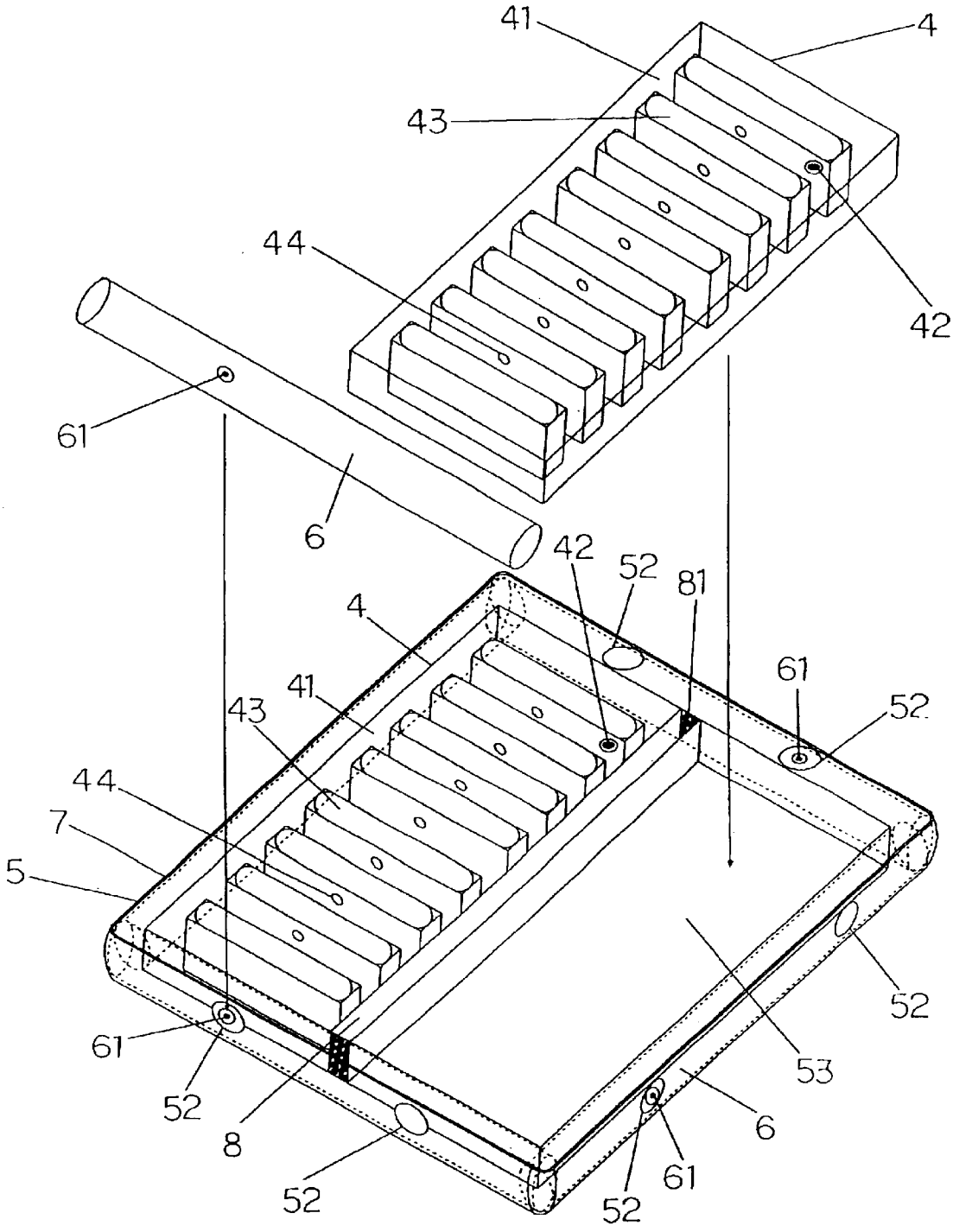
FIG. 2 shows an exploded elevational schematic view illustrating a dual-part double-bed according to the invention.

Referring to FIG. 2 showing an exploded elevational schematic view illustrating a dual-part double-bed according to the invention, the invention comprises two water containing bodies 4, a concave bed body 5, air protection borders 6 and a bed housing 7.

The concave bed body 5 has each side thereof provided with at least two openings 52 for installing four unfilled air protection borders 6 through the openings 52, thereby forming a large accommodating space 51. The accommodating space 51 has a middle part thereof disposed with a longitudinal central air bag or a long sponge 8, such that two water containing body accommodating chambers 53 are formed for placing the two water containing bodies 4. At appropriate positions, two ends of the central air bag or the long sponge are provided with adhesive tapes attached at head and foot ends of the accommodating chambers, so as to further install the water containing beds 4. Each of the four air protection borders 6 are also provided with an air inlet plug 61 for injecting air, with the air inlet plugs exactly 61 situated at the openings 52 at four sides of the concave bed body 5. The bed housing 7 is devised in an inverted U-shape. The assembled air protection borders 6 and the concave bed 5 of the water containing beds 4 are placed into the bed housing 7 in an upward direction. At this point, an upper edge of the bed housing 7 is tightly pressed against edges of the concave bed body 5, such that the openings 52 of the concave bed body 5 and the air inlet plugs 61 of the air protection borders 6 are concealed, thereby beautifying an overall appearance of the water bed as well as completely eliminating water leakage for lengthening lifespan of the water bed, and facilitating controlling elasticity for hardness and softness of the water bed. Furthermore, through a design of keeping the openings 52 of the concave bed body 5 and the air inlet plugs 61 of the air protection borders 6 exposed, periodical air refilling into the air protection borders 6 is made convenient in order to maintain normal hardness and softness, and an original shape of the water bed.

Figure 3:
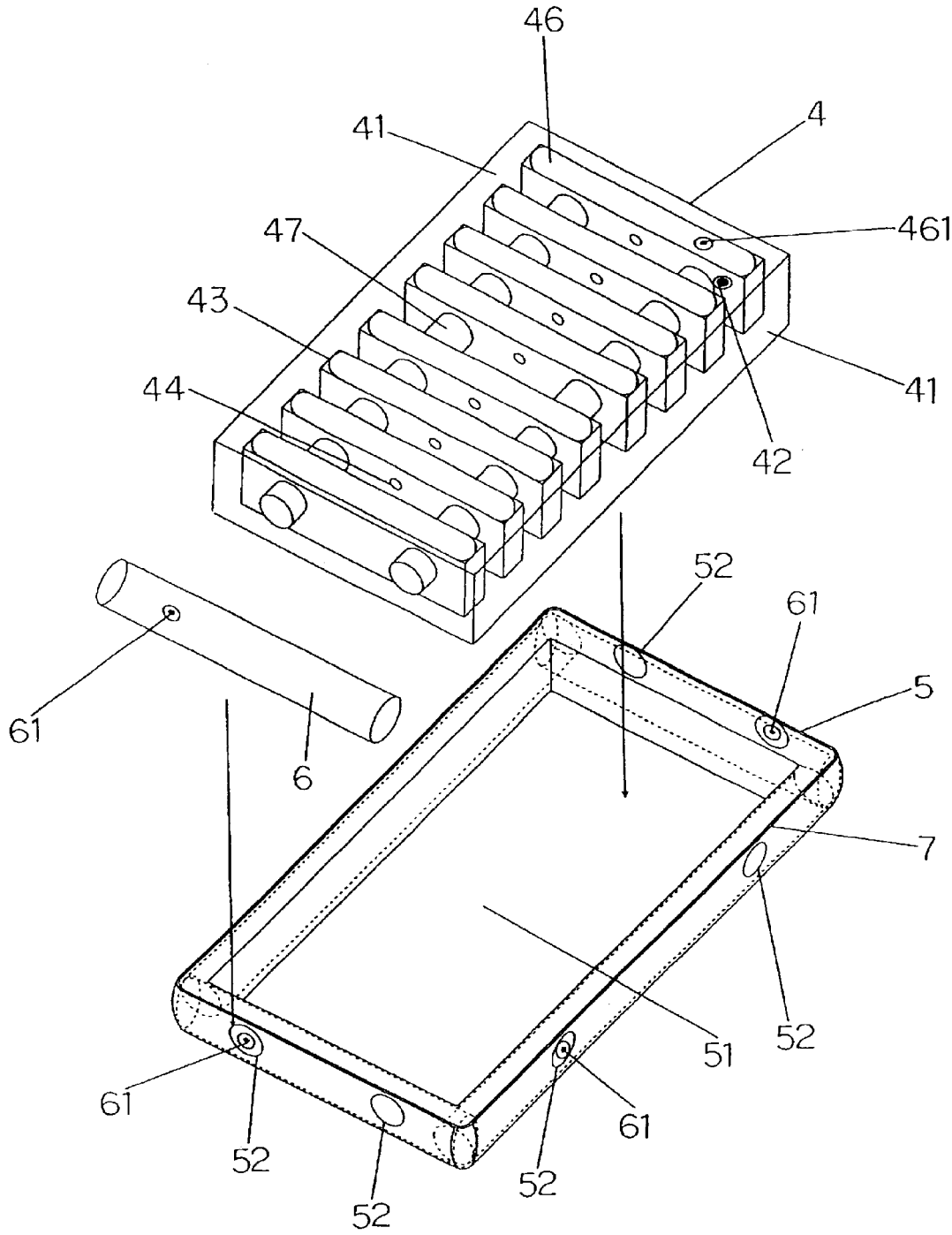
FIG. 3 shows an elevational schematic view illustrating an assembly of a single-bed according to the invention.

According to the aforesaid descriptions, the two water containing bodies 4 according to the invention are provided with water inlet plugs 42 at outer layers 41 thereof, so as to allow injection of water. Within each outer layer 41 is a plurality of parallel transverse pull strip spacers 43 that are loop-like and hollow structures. A water opening 44 is disposed at an appropriate position of each transverse pull strip spacer 43 and is for allowing circulation of injected water. Upper and lower edges of the transverse pull strip spacers 43 are molded with inner walls of the outer layers 41 of the water containing bodies 4 using heat. Each water containing body 4 is further provided with a transverse and sealed rectangular air bag 46 parallel to the transverse pull strip spacers 43 at a head end thereof. At appropriate positions, the air bag 46 is molded with a plurality of long air tubes 47, which are penetrated through all the plurality of transverse pull strip spacers 43 and stopped at an exterior of the transverse pull strip spacer 43 at the foot end of the water containing body 4. Each the sealed air bag 46 has an air inlet plug 461 at an appropriate position thereof for injecting air that is further forwarded to the plurality of long air tubes 47, thereby effectively adjusting hardness and softness of the water containing bodies 4 as shown in FIG. 3.

Figure 4:
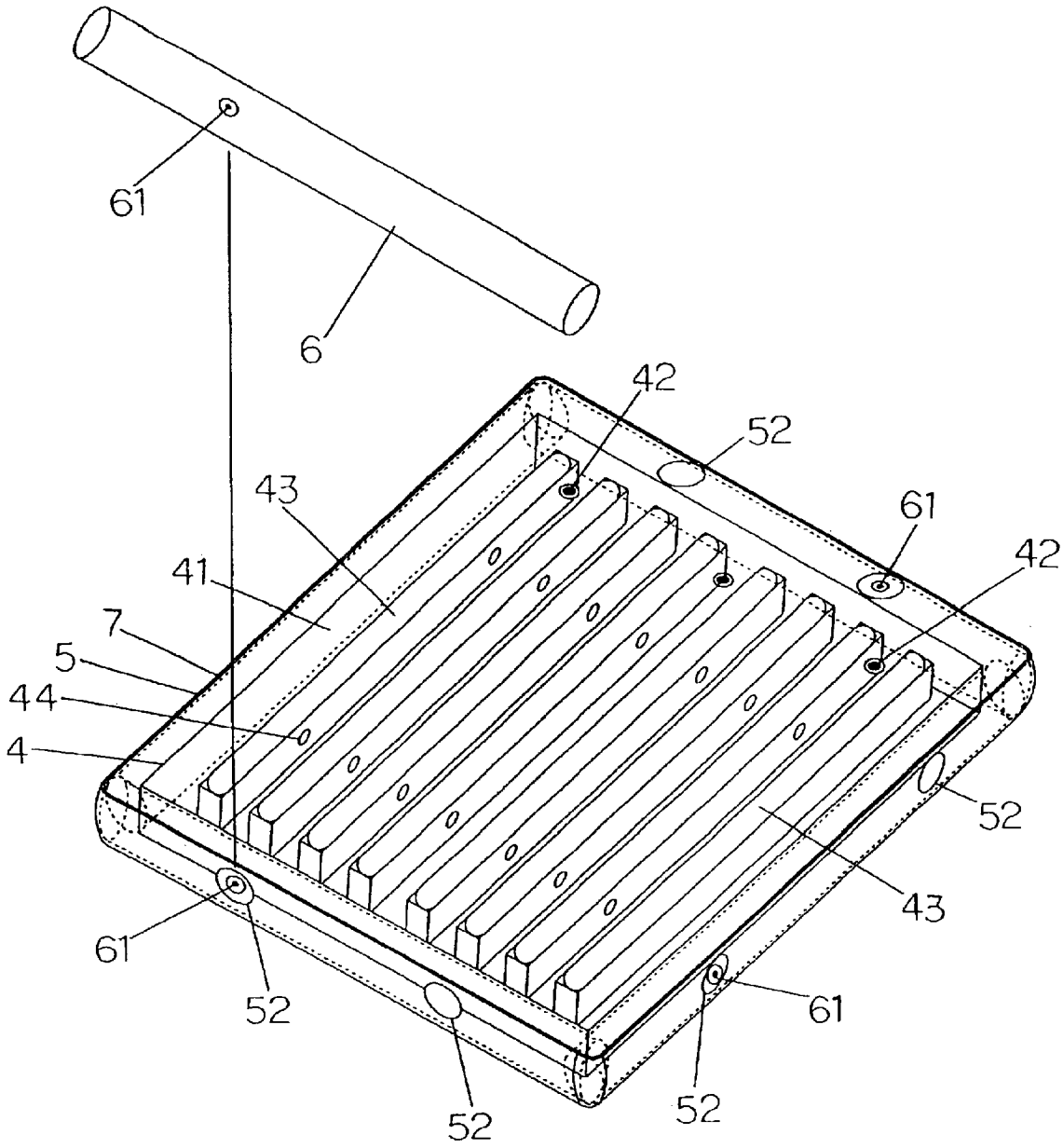
FIG. 4 shows an exploded elevational schematic view illustrating a single-part double-bed according to the invention.

Referring to FIG. 4 showing a design of a single-part double-bed according to the invention, the longitudinal central long air bag or the long sponge 8 attached to the head and foot ends of the accommodating space 51 is removed, and the plurality of transverse pull strip spacers 43 with the outer layers 41 of the aforesaid water containing bodies 4 are altered into a plurality of longitudinal pull strip spacers 45 to form a single-part double-bed. The modified water containing body 4 is then installed in the accommodating space 51. At appropriate positions, the water containing body 4 has a plurality of water inlet plugs 42 at a surface of an outer layer 41 thereof for injecting water therein. At appropriate positions, the plurality of longitudinal pull strip spacers 45 within the outer layer 41 is provided with water openings 44 for allowing circulation of water, thereby maintaining stability of water flowing in the water bed.

Figure 5:
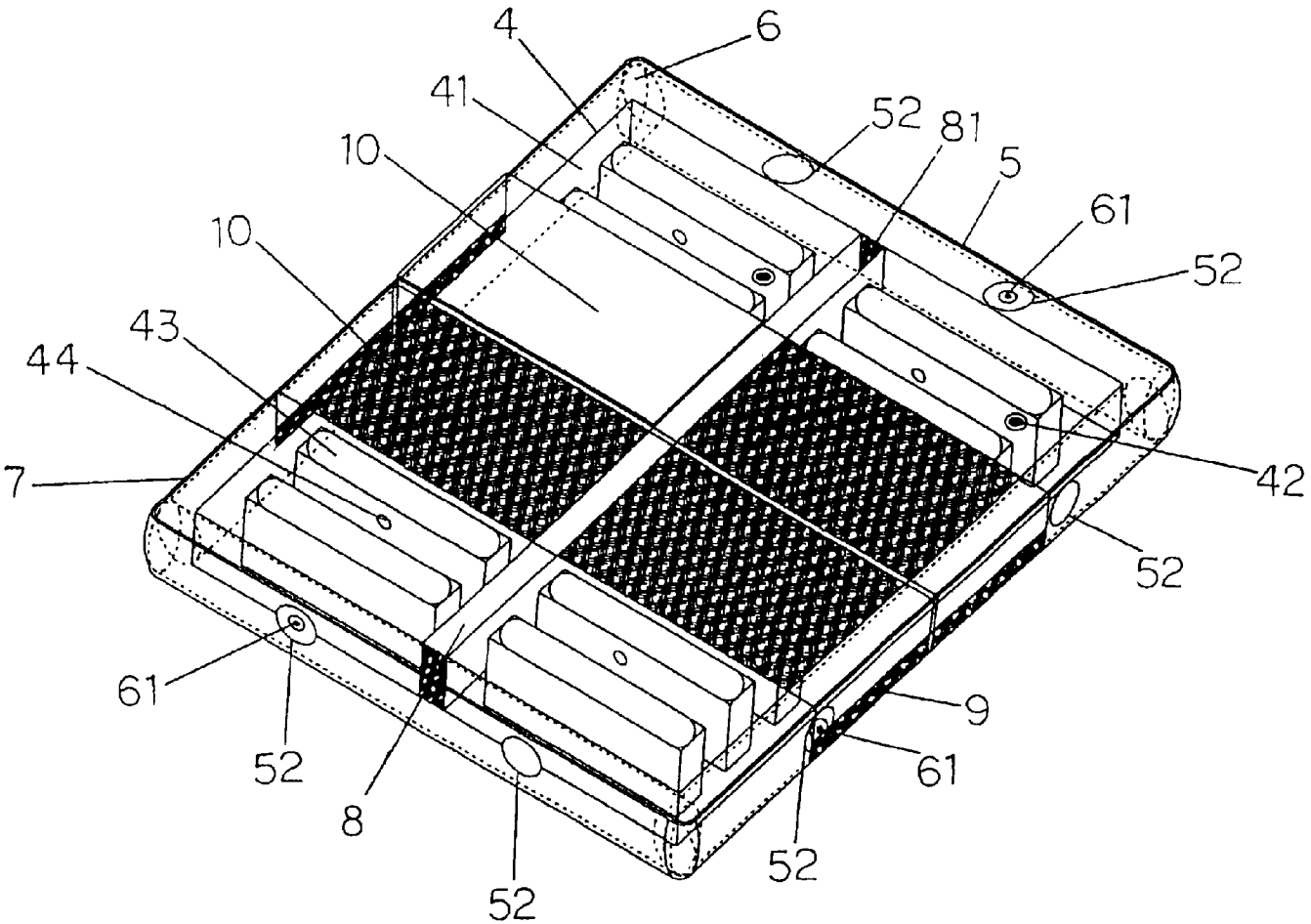
FIG. 5 shows a double-bed of another embodiment according to the invention.

In another design according to the invention, a periphery of the concave bed body 5 or the bed housing 7 is devised with adhesive tapes or zippers 9 for additionally installing various sanitary mattresses such as cold or hot compress mattresses, or other sanitary or health products such as lining mattresses of different thicknesses and hardness as shown in FIG. 5.

Conclusive from the above, the water bed structure according to the invention accomplishes targeted objects and effects using most simple structures, and offers enhanced practicability and economical values compared to prior inventions.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A water bed structure comprising water containing bodies, a concave bed body, air protection borders and a bed housing; wherein, at appropriate positions, the concave bed body has each of four sides thereof provided with at least two openings for installing four unfilled air protection borders through the openings; at appropriate positions, the four air protection borders are also provided with air inlet plugs that are exactly located at the openings at the four sides of the four air protection borders; the four air protection border form a large accommodating space when assembled; the accommodating space has a middle part thereof disposed with a longitudinal central air bag or a long sponge, such that two water containing body accommodating chambers are formed; within each of two outer layers is a plurality of parallel transverse pull strip spacers that are loop-like and hollow structures; at appropriate positions, two ends of the longitudinal central air bag or the long sponge are provided with adhesive tapes attached to head and foot ends of the accommodating chambers; the bed housing is devised in an inverted U-shape; and the assembled air protection borders and the concave bed of the water containing beds are placed into the bed housing in an upward direction, such that the openings of the concave bed body and the air inlet plugs of the air protection borders are concealed, thereby beautifying an overall appearance of the water bed, preventing the air protection borders from dilating, and lengthening usage lifespan of the water bed as well as completely eliminating a drawback of water leakage.

2. The water bed structure in accordance with claim 1, wherein, when the water containing bodies are modified into a single-part double-bed, the plurality of transverse pull strip spacers within the outer layers of the water containing bodies is altered into a plurality of longitudinal pull strip spacers to form a single-part double-bed, thereby effective eliminating left and right wavering and ensuring stability of the water bed structure.

3. The water bed structure in accordance with claim 1, wherein an upper edge of the bed housing is tightly pressed against edges of the concave bed body when assembled in an upward direction.

4. The water bed structure in accordance with claim 1, wherein a periphery of the concave bed body or the bed housing is devised with adhesive tapes or zippers for additionally installing various sanitary or health mattresses of different thicknesses and hardness.

* * * * *